US009017027B2

(12) United States Patent
Campbell et al.

(10) Patent No.: US 9,017,027 B2
(45) Date of Patent: Apr. 28, 2015

(54) COMPONENT HAVING COOLING CHANNEL WITH HOURGLASS CROSS SECTION

(71) Applicants: Christian X. Campbell, Charlotte, NC (US); Ching-Pang Lee, Cincinnati, OH (US)

(72) Inventors: Christian X. Campbell, Charlotte, NC (US); Ching-Pang Lee, Cincinnati, OH (US)

(73) Assignees: Siemens Energy, Inc., Orlando, FL (US); Mikro Systems, Inc., Charlottesville, VA (US)

( * ) Notice: Subject to any disclaimer, the term of this patent is extended or adjusted under 35 U.S.C. 154(b) by 171 days.

(21) Appl. No.: 13/760,107

(22) Filed: Feb. 6, 2013

(65) Prior Publication Data

US 2013/0149169 A1 Jun. 13, 2013

Related U.S. Application Data

(63) Continuation-in-part of application No. 12/985,553, filed on Jan. 6, 2011, now Pat. No. 8,764,394.

(51) Int. Cl.

| | |
|---|---|
| ***F01D 5/18*** | (2006.01) |
| ***F01D 25/12*** | (2006.01) |
| ***F28F 3/04*** | (2006.01) |
| ***F01D 5/14*** | (2006.01) |
| *F28F 7/02* | (2006.01) |

(52) U.S. Cl.

CPC ..... *F01D 5/183* (2013.01); *F01D 25/12* (2013.01); *F01D 5/187* (2013.01); *F28F 3/048* (2013.01); *F28F 7/02* (2013.01); *F05D 2240/304* (2013.01); *F05D 2260/2214* (2013.01); *F05D 2250/13* (2013.01); *F01D 5/147* (2013.01)

(58) Field of Classification Search

USPC ..... 415/115; 416/96 R, 97 R; 165/168, 177

See application file for complete search history.

(56) References Cited

U.S. PATENT DOCUMENTS

| | | | | |
|---|---|---|---|---|
| 5,034,716 | A * | 7/1991 | Mokadam | 336/60 |
| 5,063,662 | A | 11/1991 | Porter | |
| 5,269,058 | A | 12/1993 | Wiggs | |
| 5,370,499 | A | 12/1994 | Lee | |
| 5,496,151 | A | 3/1996 | Coudray et al. | |
| 5,498,133 | A | 3/1996 | Lee | |

(Continued)

FOREIGN PATENT DOCUMENTS

| | | | |
|---|---|---|---|
| EP | 1630353 | A2 | 3/2006 |
| EP | 2258925 | A2 | 12/2010 |
| JP | 07-190663 | A * | 7/1995 |

OTHER PUBLICATIONS

Hirao, Heating Tube, Jul. 28, 1995, JP07-190663A abstract.*

*Primary Examiner* — Liam McDowell

(57) ABSTRACT

A cooling channel (36, 36B, 63-66) cools inner surfaces (48, 50) of exterior walls (41, 43) of a component (20, 60). Interior side surfaces (52, 54) of the channel converge to a waist (W2), forming an hourglass shaped transverse profile (46). The inner surfaces (48, 50) may have fins (44) aligned with the coolant flow (22). The fins may have a transverse profile (56A, 56B) highest at mid-width of the inner surfaces (48, 50). Turbulators (92) may be provided on the side surfaces (52, 54) of the channel, and may urge the coolant flow toward the inner surfaces (48, 50). Each turbulator (92) may have a peak (97) that defines the waist of the cooling channel. Each turbulator may have a convex upstream side (93). These elements increase coolant flow in the corners (C) of the channel to more uniformly and efficiently cool the exterior walls (41, 43).

16 Claims, 5 Drawing Sheets

(56) References Cited

U.S. PATENT DOCUMENTS

| | | | | |
|---|---|---|---|---|
| 5,503,529 | A | 4/1996 | Anselmi et al. | |
| 5,511,946 | A | 4/1996 | Lee et al. | |
| 5,586,866 | A | 12/1996 | Wettstein | |
| 5,690,473 | A | 11/1997 | Kercher | |
| 5,813,836 | A | 9/1998 | Starkweather | |
| 5,947,181 | A * | 9/1999 | Davis | 164/132 |
| 6,086,328 | A | 7/2000 | Lee | |
| 6,190,129 | B1 | 2/2001 | Mayer et al. | |
| 6,254,334 | B1 | 7/2001 | LaFleur | |
| 6,273,682 | B1 | 8/2001 | Lee | |
| 6,289,981 | B1 * | 9/2001 | Tokizaki et al. | 165/177 |
| 6,379,118 | B2 | 4/2002 | Lutum et al. | |
| 6,514,042 | B2 | 2/2003 | Kvasnak et al. | |
| 6,837,683 | B2 | 1/2005 | Dailey | |
| 6,874,987 | B2 | 4/2005 | Slinger et al. | |
| 6,932,570 | B2 | 8/2005 | Heyward et al. | |
| 6,969,237 | B2 | 11/2005 | Hudson | |
| 6,981,840 | B2 | 1/2006 | Lee et al. | |
| 6,984,102 | B2 | 1/2006 | Bunker et al. | |
| 7,011,502 | B2 | 3/2006 | Lee et al. | |
| 7,080,972 | B2 | 7/2006 | Rawlinson | |
| 7,114,923 | B2 | 10/2006 | Liang | |
| 7,131,818 | B2 | 11/2006 | Cunha et al. | |
| 7,182,576 | B2 | 2/2007 | Bunker et al. | |
| 7,186,084 | B2 | 3/2007 | Bunker et al. | |
| 7,273,351 | B2 | 9/2007 | Kopmels | |
| 7,296,973 | B2 | 11/2007 | Lee et al. | |
| 7,544,044 | B1 | 6/2009 | Liang | |
| 7,563,072 | B1 | 7/2009 | Liang | |
| 7,665,956 | B2 | 2/2010 | Mitchell et al. | |
| 8,257,809 | B2 | 9/2012 | Morrison et al. | |
| 2004/0112576 | A1 * | 6/2004 | Meshenky | 165/125 |
| 2005/0274506 | A1 * | 12/2005 | Bhatti et al. | 165/177 |
| 2006/0269408 | A1 * | 11/2006 | Liang | 416/97 R |
| 2010/0303635 | A1 * | 12/2010 | Townes et al. | 416/97 R |
| 2011/0132563 | A1 | 6/2011 | Merrill et al. | |
| 2011/0132564 | A1 | 6/2011 | Merrill et al. | |
| 2012/0177503 | A1 | 7/2012 | Lee et al. | |
| 2012/0207614 | A1 | 8/2012 | Lee et al. | |

* cited by examiner

FIG 2
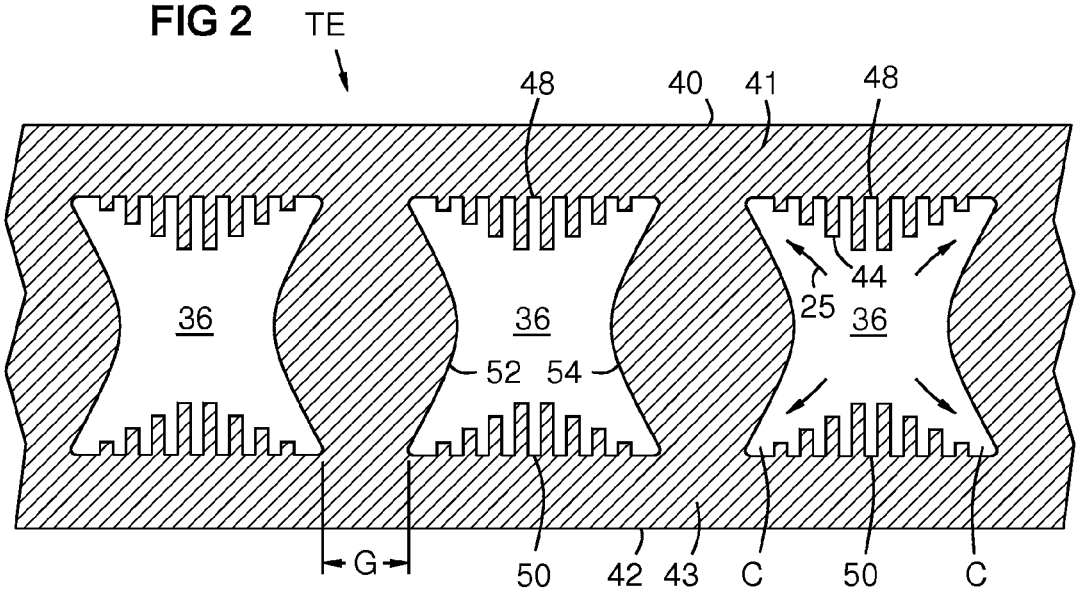
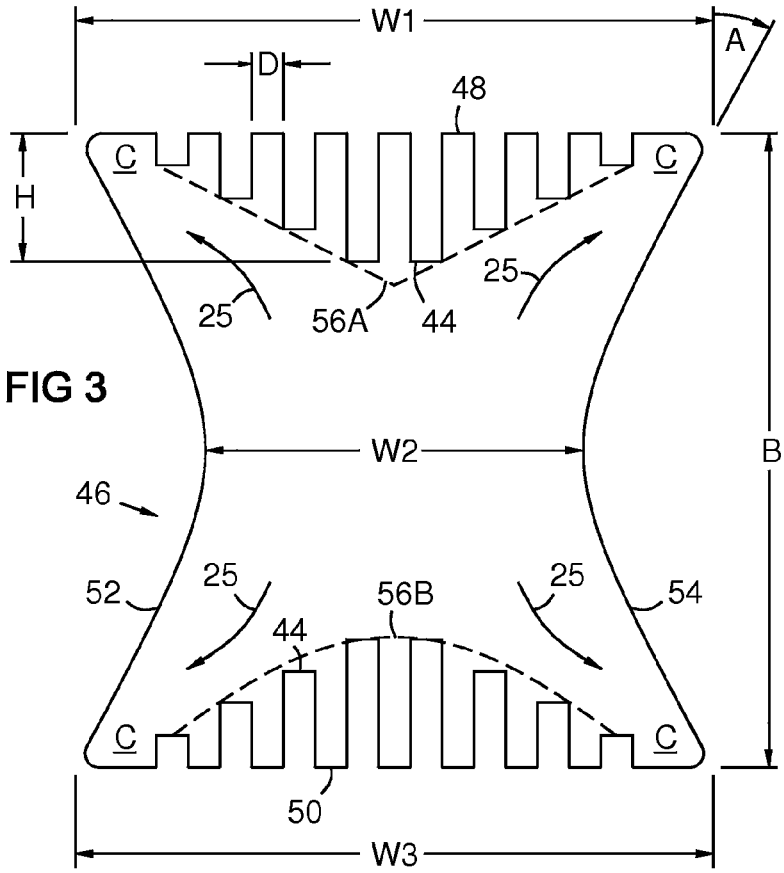
FIG 3

COMPONENT HAVING COOLING CHANNEL WITH HOURGLASS CROSS SECTION

This application is a continuation-in-part of U.S. application Ser. No. 12/985,553 filed on Jan. 6, 2011 which is incorporated by reference herein.

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

BACKGROUND OF THE INVENTION

Components in the hot gas flow path of gas turbines often have cooling channels. Cooling effectiveness is important to minimize thermal stress on these components, and cooling efficiency is important to minimize the volume of air diverted from the compressor for cooling. Film cooling provides a film of cooling air on outer surfaces of a component via holes from internal cooling channels. Film cooling can be inefficient, because a high volume of cooling air is required. Thus, film cooling has been used selectively in combination with other techniques. Impingement cooling is a technique in which perforated baffles are spaced from a surface to create impingement jets of cooling air against the surface. Serpentine cooling channels have been provided in turbine components, including airfoils such as blades and vanes. The present invention increases effectiveness and efficiency in cooling channels.

BRIEF DESCRIPTION OF THE DRAWINGS

The invention is explained in the following description in view of the drawings that show:

FIG. 2 is a sectional view of an airfoil trailing edge taken on line 2-2 of FIG. 1, with cooling channels showing aspects of the invention.

FIG. 3 is a transverse profile of a cooling channel per aspects of the invention.

DETAILED DESCRIPTION OF THE INVENTION

Figure 1:
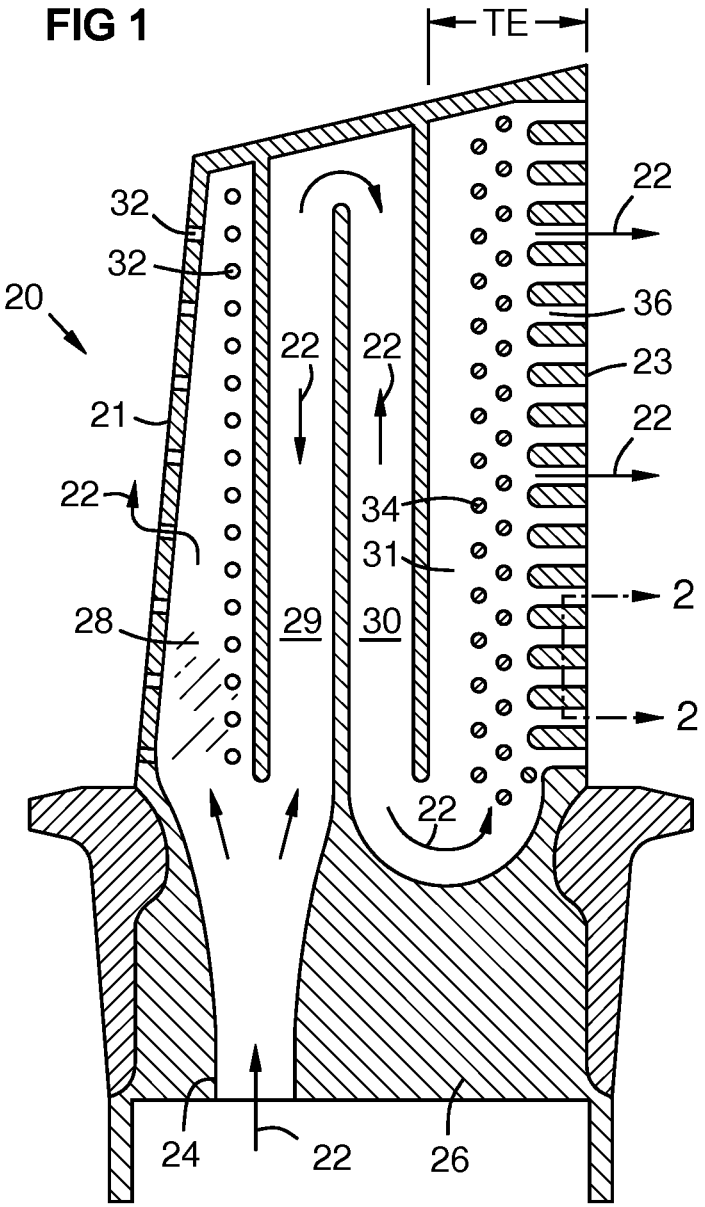
FIG. 1 is a sectional side view of a turbine blade with cooling channels.

FIG. 1 is a sectional view of a turbine blade 20 having a leading edge 21 and a trailing edge 23. Cooling air 22 from the turbine compressor enters an inlet 24 in the blade root 26, and flows through channels 28, 29, 30, 31 in the blade. Some of the coolant may exit film cooling holes 32. A trailing edge portion TE of the blade may have turbulator pins 34 and exit channels 36. Each arrow 22 indicates an overall coolant flow direction at the arrow, meaning a predominant or average flow direction at that point.

FIG. 2 is a sectional view of a turbine airfoil trailing edge portion TE taken along line 2-2 of FIG. 1. The trailing edge portion has first and second exterior surfaces 40, 42 on suction and pressure side walls 41, 43 of the airfoil. Cooling channels 36 may have fins 44 on inner surfaces 48, 50 of the exterior walls 41, 43 according to aspects of the invention. These inner surfaces 48 and 50 are called "near-wall inner surfaces" in the art, meaning an interior surface of a cooling channel that is closest to a cooled exterior surface. Gaps G between the channels produce gaps in cooling efficiency and uniformity. The inventors recognized that cooling effectiveness, efficiency, and uniformity could be improved by increasing the cooling rate in the corners C of the cooling channels, since these corners are nearest to the gaps G. One way to accomplish this preferential cooling is to provide an hourglass-shaped channel profile in which the side surfaces 52, 54 of the channel form a waist that is narrower than a width of each of the first and second inner surfaces 48 and 50. The waist functions to increase the flow resistance in the center of the channel, thereby urging the coolant toward the corners of the channel. Since coolant flow in the center of the channel does not contact a heat transfer surface whereas flow in the corners does function to remove heat, the present invention is effective to increase the efficiency of the cooling.

FIG. 3 is a transverse sectional profile 46 of a cooling channel that is shaped to efficiently cool two opposed exterior surfaces. The channel may be a trailing edge channel 36 or any other cooling channel, such as channels 29 and 30 in FIG. 1. It has two opposed near-wall inner surfaces 48, 50, which may be parallel to the respective exterior surfaces 40, 42 of FIG. 2. Here "parallel" means with respect to the portions of the near-wall inner surface closest to the exterior surface, not considering the fins 44. The channel has widths W1, W3 at the near-wall inner surfaces 48, 50. Two interior side surfaces 52, 54 taper toward each other from the sides of the inner surfaces 48, 50, defining a minimum channel width W2 or waist in the side surfaces. The inner surface widths W1 and W3 are greater than the waist width W2, so the channel profile 46 has an hourglass shape formed by convexity of the side surfaces 52, 54. This shape increases the coolant flow 25 toward the corners C of the channel. The overall coolant flow direction is normal to the page in this view. The arrows 25 illustrate a flow-increasing aspect of the profile 46 relative to a channel without an hourglass shape and/or without fins next described.

Fins 44 may be provided on the inner surfaces 48, 50. The fins may be aligned with the overall flow direction 22 (FIG. 1) which is normal to the plane of FIG. 3. If fins are provided, they may have heights that follow a convex profile such as 56A or 56B, providing a maximum fin height H at mid-width of the near-wall inner surface 48 and/or 50. These fins 44 increase the surface area of the near-wall surfaces 48, 50, and also increase the flow 25 in the corners C. The taller middle fins reduce the flow centrally, while the shorter distal fins encourage flow 25 in the corners C. The combination of convex sides 52, 54 and a convex fin height profile 56A, 56B provides synergy that focuses cooling toward the channel corners C.

Dimensions of the channel profile 46 may be selected using known engineering methods. The illustrated proportions are provided as an example only. The following length units are dimensionless and may be sized proportionately in any unit of measurement, since proportion is the relevant aspect exemplified in this drawing. In one embodiment the relative dimensions are B=1.00, D=0.05, H=0.20, W1=1.00, W2=0.60. The side taper angle A=−30° in this example. Herein, a negative taper angle A of sides 52, 54 in the profile 46 means the sides converge toward each other toward an intermediate position between the inner surfaces 48, 50, forming a waist W2 as shown. In some embodiments the taper angle A may range from −1° to −30°. The waist width W2 may be determined by the taper angle. Alternately it may be 80% or less of one or both of the near wall widths W1, W3, or 65% or less in certain embodiments. One or more proportions and/or dimensions may vary along the length of the cooling channel. For example, dimension B may vary with the thickness of the airfoil. The widths W1, W3 of the two inner surfaces 48 and 50 may differ from each other in some embodiments. In this case, the waist W2 may be narrower than each of the widths W1, W3.

Figure 4:
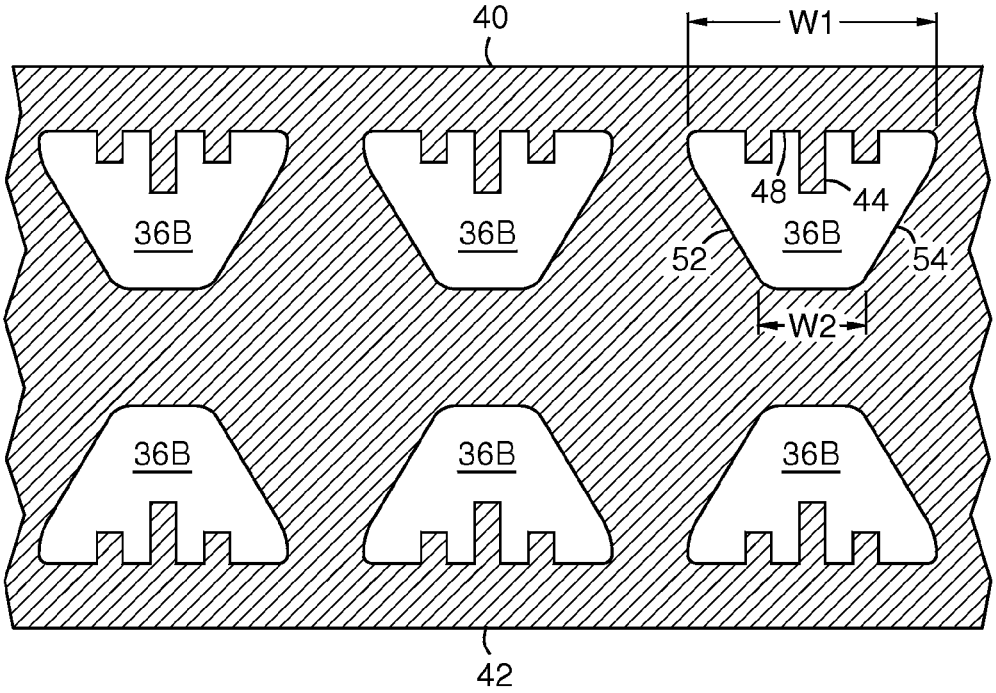
FIG. 4 is a sectional view of one-sided near-wall cooling channels.

FIG. 4 shows a cooling channel 36B shaped to cool a single exterior surface 40 or 42. It uses the fin and taper angle concepts of the cooling channel 36 previously described. The near-wall inner surface width W1 is greater than the minimum channel width W2 due to tapered interior side surfaces 52, 54. Fins 44 may be provided on the near-wall inner surface 48, and they may have a convex height profile centered on the width W1 of the near-wall inner surface. Such cooling channels 36B may be used for example in a relatively thicker part of a trailing edge portion TE of an airfoil rather than the relatively thinner part of the trailing edge portion TE where a cooling profile 46 as in FIG. 3 might be used. The transverse sectional profile of this embodiment may be trapezoidal, in which the near-wall inner surface 48 defines a longest side thereof.

Figure 5:
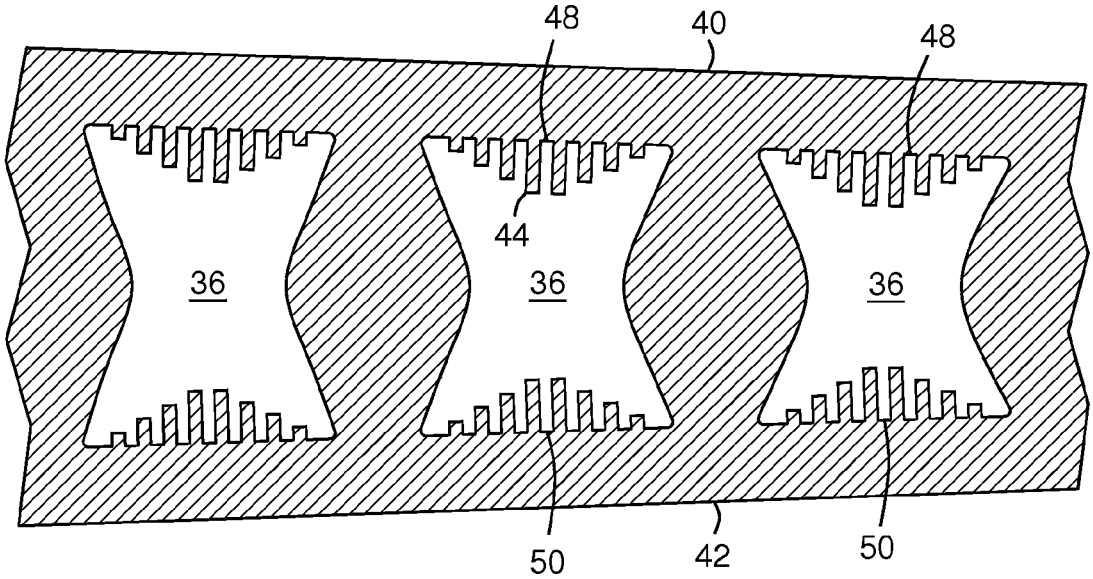
FIG. 5 is a sectional view of cooling channels in a tapered component.

FIG. 5 shows that the exterior surfaces 40 and 42 may be non-parallel in a transverse section plane of the channel 36. The near-wall inner surfaces 48, 50 may be parallel to the exterior surfaces 40, 42.

Figure 6:
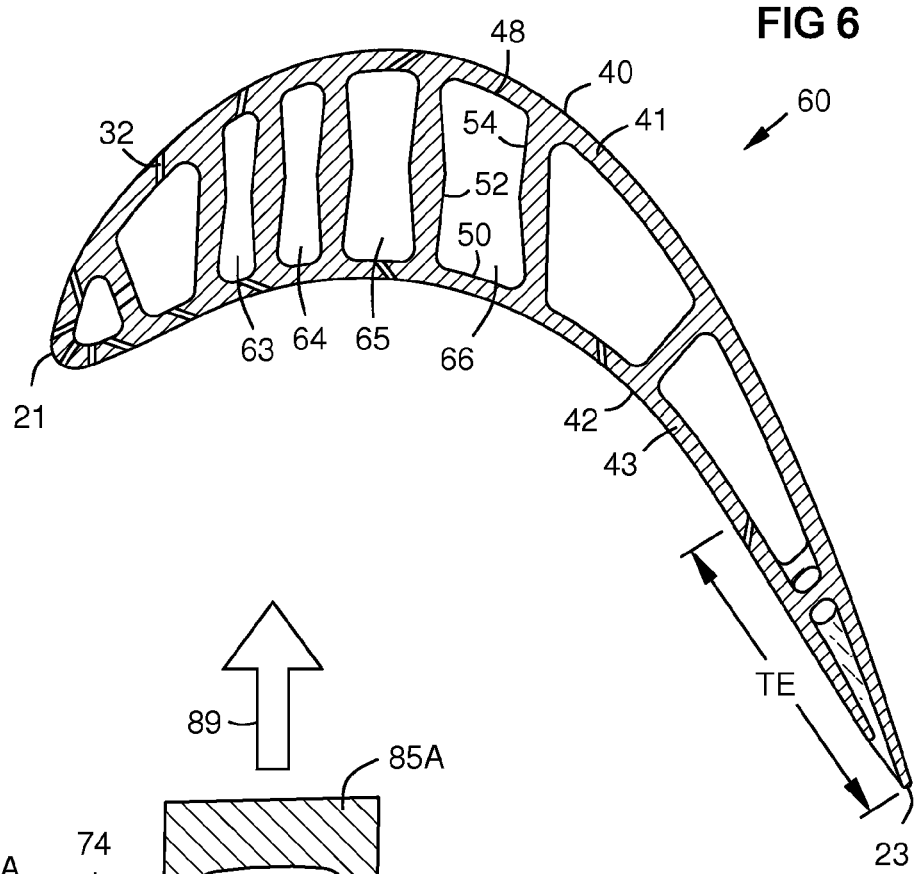
FIG. 6 is a transverse sectional view of a turbine airfoil with hourglass shaped cooling channels.

FIG. 6 shows a transverse section of a turbine airfoil 60 with hourglass-shaped span-wise cooling channels 63, 64, 65, and 66. Herein "span-wise" means the channel is oriented in a direction between radially inner and outer ends of the airfoil. "Radial" is with respect to the turbine axis of rotation. For example, in FIG. 1 channels 28, 29, 30, and 31 are span-wise channels. These channels may optionally have fins 44 as previously described regarding FIG. 3.

Figure 7:
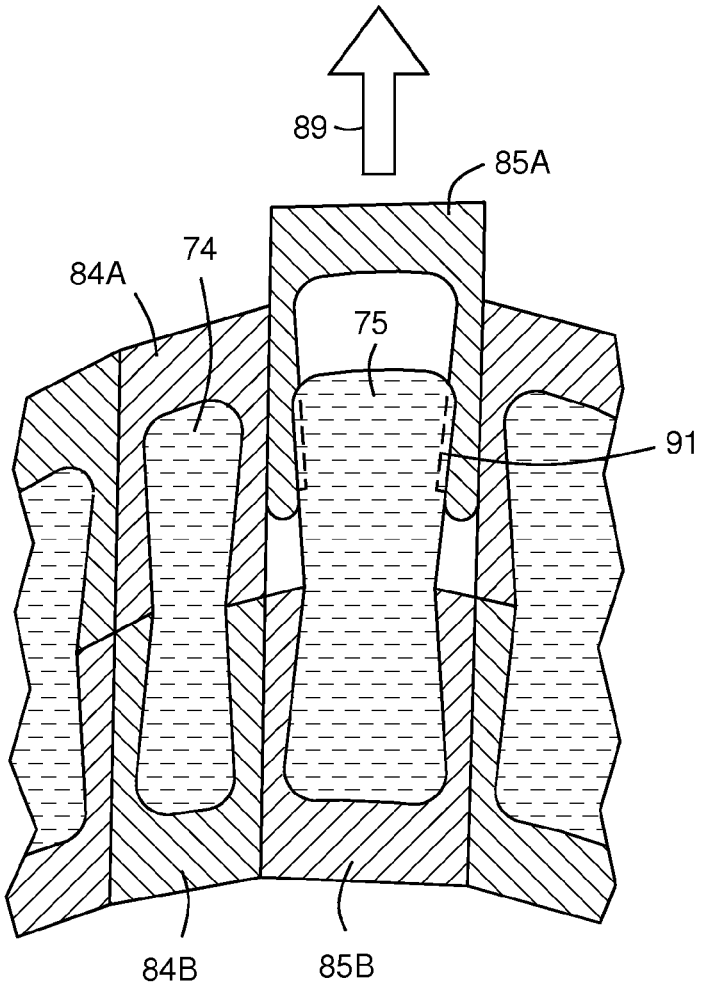
FIG. 7 shows a process of molding ceramic cores for a mold for hourglass shaped cooling channels.

FIG. 7 shows a process of forming ceramic cores 74, 75 for an airfoil mold. The cores may be chemically removed after casting of the airfoil 60. Flexible dies 84A, 84B, 85A, 85B or dies with flexible liners may be used to form the cores 74, 75 of a green-body ceramic that is stiff enough for pulling 89 of the dies elastically past interference points 91. Such technology is taught for example in U.S. Pat. Nos. 7,141,812 and 7,410,606 and 7,411,204 assigned to Mikro Systems Inc. of Charlottesville, Va. Even small negative taper angles such as −1 to −3 degrees are significant and useful for cooling efficiency compared to the positive taper angles required for removal of conventional rigid dies.

Figure 8:
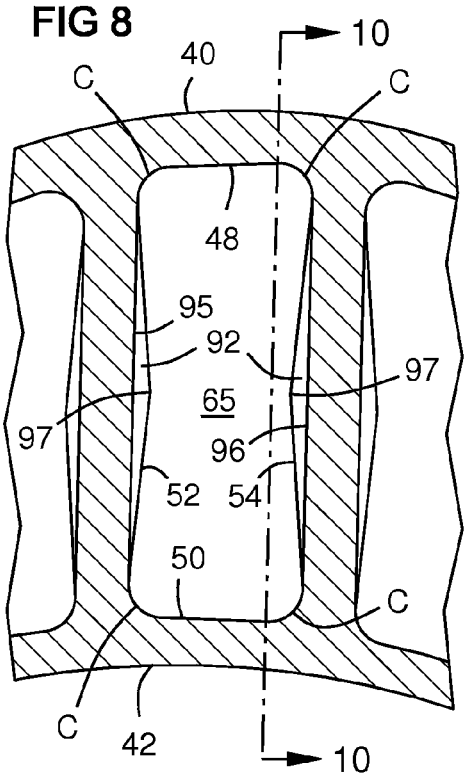
FIG. 8 shows a transverse sectional view of an hourglass shaped cooling channel with converging side surfaces defined by peaked turbulators.

FIG. 8 shows a transverse sectional view of an hourglass shaped cooling channel 65 with converging side surfaces 52, 54 defined by turbulators 92. Each turbulator has a peak 97 in a middle portion thereof that defines the waist of the cooling channel. The side surfaces 52, 54 on the turbulators may have the taper range previously described, or especially in the range of −2 to −5 degrees (−5 degrees shown). The turbulators 92 may alternate with surfaces 95, 96 that are flat (shown) or have positive taper (not shown).

Figure 9:
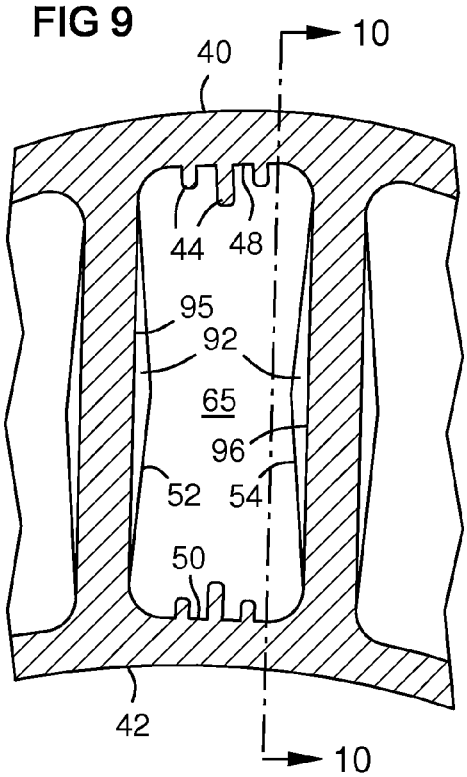
FIG. 9 shows an embodiment as in FIG. 8 combined with fins on the near-wall inner surfaces.

FIG. 9 shows an embodiment as in FIG. 8 combined with profiled fins 44 on the near-wall inner surfaces 48, 50 as previously described.

Figure 10:
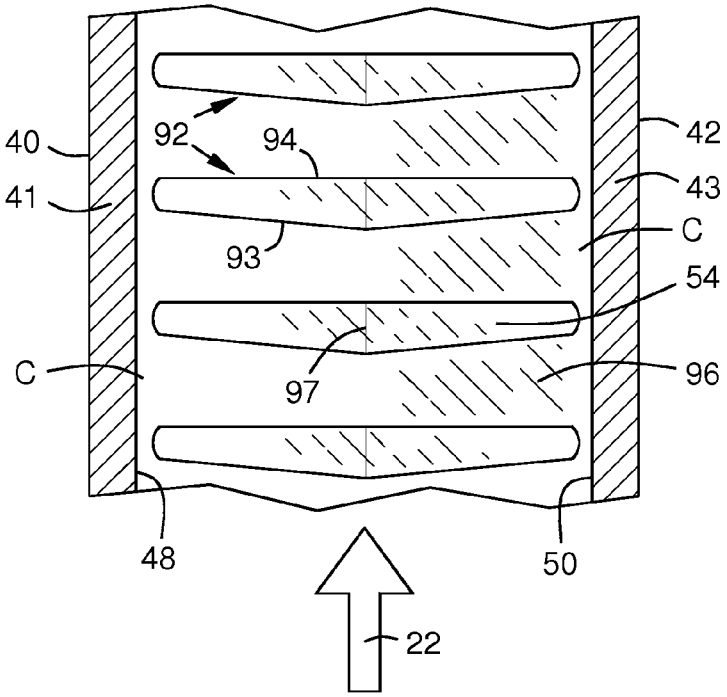
FIG. 10 is a view taken along line 10-10 of FIG. 8 showing peaked turbulators with convex upstream sides.

FIG. 10 is a view taken along line 10-10 of FIG. 8 showing peaked turbulators 92 with convex upstream sides 93 and straight downstream sides 94. The convex upstream sides 93 urge the flow 22 toward the corners C. The straight downstream sides 94 facilitate pulling the dies 84A, 84B, 85A, 85B of FIG. 7 straight out, normal to the cores 74, 75. Alternately, the downstream sides 94 of the turbulators may be convex (not shown) such as parallel to the upstream sides 93.

The embodiments of FIGS. 8-10 can be fabricated using the cost-effective process of FIG. 7. The turbulators 92 concentrate the coolant flow toward the near-wall inner surfaces 48 and 50 and into the corners C. The combination features shown in FIG. 9 is especially effective and efficient, since the turbulators 92 slow the flow 22 centrally while concentrating it toward the inner surfaces 48 and 50, where the ribs 44 transfer heat from the exterior surfaces 40, 42, and increase the flow 22 toward the corners C.

The present hourglass-shaped channels are useful in any near-wall cooling application, such as in vanes, blades, shrouds, and possibly in combustors and transition ducts of gas turbines. They increase uniformity of cooling, especially in a parallel series of channels with either parallel flows or alternating serpentine flows. The present channels may be formed by known fabrication techniques—for example by casting an airfoil over a positive ceramic core that is chemically removed after casting.

A benefit of the invention is that the near-wall distal corners C of the channels remove more heat than prior cooling channels for a given coolant flow volume. This improves efficiency, effectiveness, and uniformity of cooling by overcoming the tendency of coolant to flow more slowly in the corners. Increasing the corner cooling helps compensate for the cooling gaps G between channels. The invention also provides increased heat transfer from the primary surfaces 40, 42 to be cooled through the use of the fins 44.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A component comprising an interior cooling channel, the cooling channel further comprising:

first and second inner surfaces of respective first and second exterior walls of the component;

first and second side surfaces spanning between the inner surfaces; and a plurality of turbulators on each of the side surfaces that urge the coolant toward the inner surfaces, wherein a peak in a middle portion of each turbulator defines a waist of the cooling channel;

wherein a transverse section of the channel has an hourglass-shaped profile in which the waist is narrower than a width of each of the first and second inner surfaces; and wherein an overall direction of a coolant flow in the channel is normal to the hourglass-shaped profile.

2. The component of claim 1, wherein the first and second inner surfaces are parallel to respective first and second portions of exterior surfaces of the respective exterior walls.

3. The component of claim 1, wherein the first and second exterior walls are respectively pressure and suction sides of a turbine airfoil.

4. The component of claim 1, wherein the waist comprises a width of 80% or less than the width of at least one of the inner surfaces.

5. The component of claim 1, wherein the each of the turbulators comprises two surfaces that converge toward the waist, wherein each of the converging surfaces has a taper angle in the profile of at least −1 degrees toward the waist relative to a straight line between corresponding ends of the two side surfaces.

6. The component of claim 1, further comprising a plurality of parallel fins with a transverse height profile that is convex across a width of at least one of the inner surfaces, wherein the fins are oriented with the coolant flow direction.

7. The component of claim 1, wherein each turbulator comprises a convex upstream side.

8. The component of claim 1, wherein each turbulator comprises a convex upstream side and a straight downstream side.

9. The component of claim 1, further comprising:

a plurality of parallel fins oriented with the coolant flow direction on each of the inner surfaces, wherein a height profile that transversely connects adjacent peaks of the fins is convex across a width of each of the inner surfaces; and wherein each turbulator comprises a convex upstream side.

10. The component of claim 1, wherein the each of the turbulators comprises two surfaces converging toward the waist, wherein each of the converging surfaces has a taper angle in the profile of −2 to −5 degrees relative to a straight line between corresponding ends of the two interior side surfaces.

11. A turbine airfoil component comprising a coolant exit channel in a trailing edge portion, the coolant exit channel further comprising:

first and second near-wall inner surfaces parallel to respective first and second exterior surfaces of the trailing edge portion;

two interior side surfaces between the near-wall inner surfaces that converge to a waist at an intermediate position between the first and second near-wall inner surfaces forming an hourglass-shaped transverse profile of the channel;

a plurality of fins on each of the near-wall inner surfaces, wherein the fins are aligned with an overall flow direction of the coolant exit channel, and the plurality of fins has a convex height profile across the width of each near-wall inner surface; and a plurality of turbulators on each of the side surfaces that urge the coolant flow toward the near-wall inner surfaces, wherein a peak in a middle portion of each turbulator defines the waist of the cooling channel.

12. The component of claim 11, wherein each turbulator comprises a convex upstream side.

13. The component of claim 11, wherein each turbulator comprises a convex upstream side and a straight downstream side.

14. A component comprising a cooling channel, the cooling channel further comprising:

a first inner surface parallel to a first exterior surface of the component and a tapered transverse sectional profile that is wider at the first inner surface and narrower away from the first inner surface;

a second inner surface parallel to a second exterior surface of the component;

first and second interior side surfaces spanning between the first and second inner surfaces;

a plurality of turbulators on each of the interior side surfaces of the channel that urge the coolant flow toward the inner surfaces, wherein a peak in a middle portion of each turbulator defines a waist of the cooling channel that is narrower than a width of either of the first and second inner surfaces;

and a plurality of parallel fins with a transverse height profile that is convex across a width of the inner surface, wherein the fins are oriented with a direction of a coolant flow in the channel;

wherein the cooling channel is effective to urge the coolant flow therein toward corners of the cooling channel.

15. The component of claim 14, wherein each turbulator comprises a convex upstream side.

16. The component of claim 14, wherein each turbulator comprises a convex upstream side and a straight downstream side.

* * * * *